US012679507B2

(12) United States Patent
Lee et al.

(10) Patent No.: US 12,679,507 B2
(45) Date of Patent: Jul. 14, 2026

(54) FLOATING BODY WITHOUT SEPARATE CONNECTION DEVICE AND CONNECTION METHOD THEREOF

(71) Applicant: Korea Institute of Ocean Science & Technology, Busan Metropolitan City (KR)

(72) Inventors: Kang Su Lee, Incheon (KR); Byoung Jae Park, Daejeon (KR); Byoung Wan Kim, Daejeon (KR); Min Suk Ki, Sejong-si (KR); Hyun Suk Kim, Sejong-si (KR); Hyun Sung Kim, Daejeon (KR)

(73) Assignee: Korea Institute of Ocean Science & Technology, Busan Metropolitan City (KR)

( * ) Notice: Subject to any disclaimer, the term of this patent is extended or adjusted under 35 U.S.C. 154(b) by 774 days.

(21) Appl. No.: 18/060,453

(22) Filed: Nov. 30, 2022

(65) Prior Publication Data

US 2023/0115884 A1 Apr. 13, 2023

Related U.S. Application Data

(63) Continuation of application No. PCT/KR2021/004204, filed on Apr. 5, 2021.

(30) Foreign Application Priority Data

Jun. 29, 2020 (KR) ..... 10-2020-0079207

(51) Int. Cl.
*B63B 21/02* (2006.01)
*B63B 21/20* (2006.01)

(52) U.S. Cl.
CPC ..... *B63B 21/02* (2013.01); *B63B 21/20* (2013.01); *B63B 2021/203* (2013.01)

(58) Field of Classification Search
CPC ..... B63B 21/00; B63B 21/02; B63B 21/20; B63B 2021/203; B63B 35/00;
(Continued)

(56) References Cited

U.S. PATENT DOCUMENTS 6,231,349 B1 * 5/2001 Bullinger ..... H01R 13/7037 439/1

FOREIGN PATENT DOCUMENTS

| | | |
|---|---|---|
| KR | 10-1520731 B1 | 5/2015 |
| KR | 10-1641079 B1 | 7/2016 |
| KR | 10-2107297 B1 | 5/2020 |

* cited by examiner

*Primary Examiner* — Daniel V Venne
(74) *Attorney, Agent, or Firm* — Knobbe, Martens, Olson & Bear, LLP

(57) ABSTRACT

A floating body to which an aquatic or marine facility is installed or which is connected to a lower part of the aquatic or marine facility to hold the aquatic or marine facility on water or the sea is proposed. The floating body may include a main floating body which floats on water or the sea by using buoyancy, and a magnet provided on a first vertical side of the main floating body. The floating body may also include a coupling member provided on an opposite vertical side of the main floating body by corresponding to a magnet of another floating body such that the coupling member is coupled thereto, and a mooring line installed on a part of the main floating body to moor and hold the main floating body on water or the sea.

5 Claims, 3 Drawing Sheets

(58) Field of Classification Search
CPC ..... B63B 35/28; B63B 35/38; B63B 73/40;
B63B 2231/04; E02B 3/064; H01F 7/06
USPC ..... 114/218, 256, 264, 267
See application file for complete search history.

FLOATING BODY WITHOUT SEPARATE CONNECTION DEVICE AND CONNECTION METHOD THEREOF

CROSS REFERENCE TO RELATED APPLICATIONS

This is a continuation application of International Patent Application No. PCT/KR2021/004204, filed on Apr. 5, 2021, which claims priority to Korean patent application No. KR 10-2020-0079207 filed on Jun. 29, 2020, contents of both of which are incorporated herein by reference in their entireties.

BACKGROUND

Technical Field

The present disclosure relates generally to a floating body and a connection method thereof. More particularly, the present disclosure relates to a floating body without a separate connection device whereby floating bodies can be connected with each other without separate connection devices, and a connection method thereof.

Description of Related Technology

A floating body, which is a means to provide space of a predetermined area while floating on water, serves as a marine playground, a place for leisure such as fishing, a transportation means for transporting people or objects by assisting a general ship, or a military training temporary bridge. Particularly, a floating body that is often used in the sea or in a lake includes a floating pier and a barge.

A floating pier, which is a marine berthing facility that connects a bridge installed at the pier and a barge to each other, is used as a facility for safe anchorage of various ships, safe movement of people disembarking from a ship to land by using the floating pier, or safe embarkation of people on a ship by using the floating pier on land despite the vertical movement of the pier due to the change of a sea level and the horizontal movement thereof due to a wave.

SUMMARY

One aspect is a floating body without a separate connection device which has a function of connecting floating bodies to each other without separate connection devices which connect the floating bodies to each other, and a connection method thereof.

Another aspect is a floating body without a separate connection device which is moored on water to install aquatic facilities on the floating body or which provides space for aquatic activities, the floating body including a main floating body which floats on water by using buoyancy; a magnet provided on a first vertical side of the main floating body; a coupling member which is provided on an opposite vertical side of the main floating body by corresponding to a magnet of another floating body such that the coupling member is coupled thereto; and a mooring line which is installed on a part of the main floating body and moors and holds the main floating body on water or sea.

In addition, the magnet may be an electromagnet.

Furthermore, the electromagnet which is the magnet may be magnetized or have a magnetic pole adjusted by control of a controller.

In addition, the coupling member may be steel with magnetism.

Furthermore, the coupling member may be a magnet.

A floating body connection method of using the floating body without a separate connection device described above includes: installing a magnet on a first vertical side of the floating body; installing a coupling member, which is steel, coupled to an opposite vertical side of the floating body by corresponding to a magnet of another floating body; arranging the floating bodies by matching the magnets and coupling members of the floating bodies passing through the magnet installation and the coupling member installation; and holding the floating bodies, by a mooring line, floating on water by being connected to each other after the arranging of the floating bodies.

In addition, the magnet may be an electromagnet which is magnetized or has a magnetic pole adjusted by control of a controller.

According to an embodiment of the present disclosure, floating bodies can be connected to each other without connection devices by using a magnet and coupling member provided on a part of the main floating body.

Accordingly, the floating bodies are connected to each other more conveniently than by using separate connection devices such as hinges, joints, wires, or chains, and it is possible to prevent a situation in which the floating bodies are disconnected from each other due to wear of the connection devices due to the influence of the current.

However, effects obtained from the present disclosure are not limited to effects described above, and other effects not described above will be clearly appreciated from the following description by those skilled in the art.

BRIEF DESCRIPTION OF THE DRAWINGS

The following drawings attached to the present specification illustrate an exemplary embodiment of the present disclosure, and serve to help the further understanding of the technical spirit of the present disclosure together with the detailed description of the present disclosure to be described later, so the present disclosure should not be construed as being limited only to matters described in the drawings.

DETAILED DESCRIPTION

Figure 1:
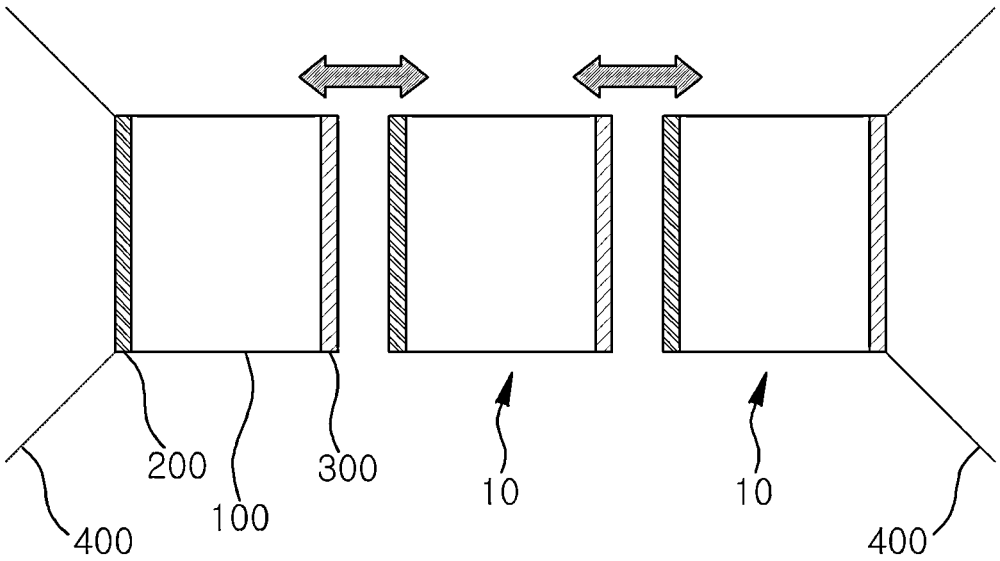
FIG. 1 is a top plan view of floating bodies without a separate connection device according to the embodiment of the present disclosure.

A floating pier is also widely used as a marine workshop and a water leisure facility.

Barges refer to cargo carriers used in canals, rivers, and ports, and most of the barges are slow to move or do not have their own power.

A floating body is a concept that includes a floating pier and a barge, and when the floating body is used in connection with land, the floating body is a floating pier, and when the floating body is used without being connected to land, the floating body is a barge.

Floating bodies according to a conventional technology are connected to each other by separate connection devices such as hinges or joints, but are moved depending on environmental conditions such as waves, currents, and winds, and accordingly, there are problems such as collision between the floating bodies, and the disconnection or fatigue damage of the connection devices.

Hereinafter, an embodiment of the present disclosure will be described in detail with reference to the accompanying drawings such that those skilled in the art can easily embody the present disclosure. However, since the embodiment of the present disclosure is merely an embodiment for structural or functional description, the scope of the present disclosure should not be construed as being limited to the embodiment described herein. That is, since the embodiment may have various changes and may have various forms, it should be understood that the scope of the present disclosure includes equivalents capable of realizing the technical spirit. In addition, the objectives or effects presented in the present disclosure do not mean that a specific embodiment should include all thereof or only such effects, so the scope of the present disclosure should not be construed as being limited thereto.

The meaning of terms described in the present disclosure should be understood as follows.

Terms such as "first" and "second" are for distinguishing one component from another, and the scope of claims should not be limited to these terms. For example, a first component may be termed a second component, and similarly, a second component may also be termed a first component. When a component is referred to as "connected" to another component, it may be directly connected to the another component, but it should be understood that other components may be present therebetween. On the other hand, when it is mentioned that a certain element is "directly connected" to another element, it should be understood that other elements are not present therebetween. Meanwhile, other expressions describing the relationship between elements, that is, "between" and "directly between" or "neighboring to" and "directly adjacent to", etc., should be interpreted in a similar manner.

A singular expression is to be understood to include a plural expression unless the context clearly dictates otherwise. Terms such as "include" or "have" are intended to designate that the described feature, number, step, operation, component, or combination thereof exists, and it should be understood that the terms do not preclude that one or more other features, numbers, steps, operations, components, or combinations thereof may be present or added.

All terms used herein have the same meaning as commonly understood by those skilled in the art to which the present disclosure belongs, unless otherwise defined. Terms defined in a dictionary used commonly should be interpreted as being consistent with the meaning of the context of the related art, and cannot be interpreted as having an ideal meaning or an excessively formal meaning unless explicitly defined in the present disclosure.

Figure 2:
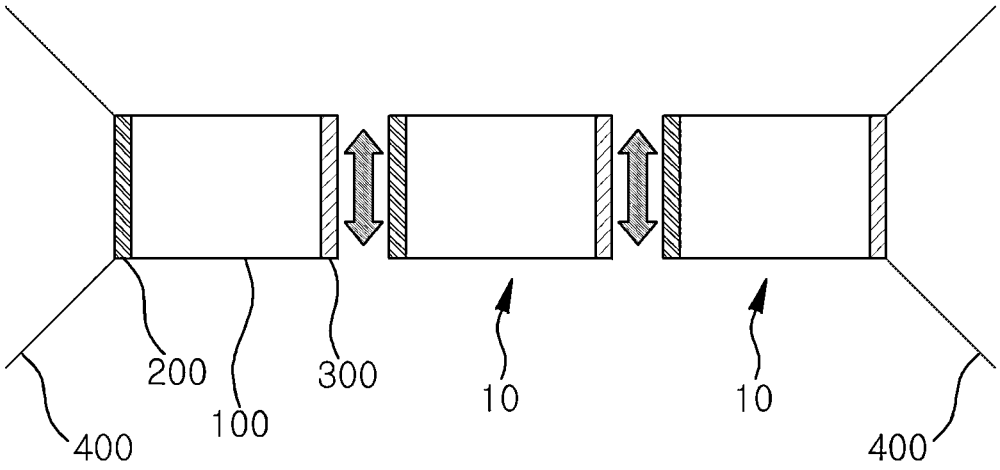
FIG. 2 is a sectional view of the floating bodies without a separate connection device according to the embodiment of the present disclosure.

FIG. 1 is a top plan view of floating bodies without a separate connection device according to the embodiment of the present disclosure, and FIG. 2 is a sectional view of the floating bodies without a separate connection device according to the embodiment of the present disclosure. In some embodiments, a floating body may be configured to be moored on water or sea to install or provide space for aquatic or marine facilities, the floating body being connectable to an adjacent floating body without a separate connection device. The floating body may include a main floating body configured to float on water or sea by using buoyancy, the main floating body comprising top and bottom surfaces opposing each other, and a magnet provided on a first vertical side of the main floating body, the magnet extending along the first vertical side from the top surface to the bottom surface of the main floating body. The floating body may also include a coupling member provided on an opposite vertical side of the main floating body, the coupling member extending along the opposite vertical side from the top surface to the bottom surface of the main floating body, the coupling member being configured to engage with a magnet of an adjacent floating body such that the main floating body is connectable to the adjacent floating body along the first vertical side and the opposite vertical side of the main floating body. The floating body may further include a mooring line mechanically installed on a portion of the main floating body and configured to physically moor and hold the main floating body on water or sea independently of the coupling member. The magnet may include an electromagnet. The electromagnet may be configured to be magnetized or has an adjustable magnetic pole. The coupling member may include steel with magnetic properties. In some embodiments, a floating body connection method is provided for connecting a first floating body and a second floating body configured to be moored on water or sea to install or provide space for aquatic or marine facilities, the first and second floating bodies being connectable to each other without a separate connection device. The method may include installing a first magnet on a first vertical side of the first floating body, the first magnet extending along the first vertical side from a top surface to a bottom surface of the first floating body, and installing a first coupling member coupled to an opposite vertical side of the first floating body, the first coupling member extending along the opposite vertical side from the top surface to the bottom surface of the first floating body, the first coupling member being configured to engage with a second magnet of the second floating body such that the first coupling member is connectable to the second floating body along the first vertical side and the opposite vertical side of the first floating body. The method may also include arranging the first and second floating bodies by matching the first magnet and the first coupling member of the first floating body and the second magnet and the second coupling member of the second floating body so that the first magnet and the first coupling member magnetically engage respectively with the second coupling member and the second magnet along the vertical sides the first vertical side and the opposite vertical side of the first floating body. The method may further include holding the first and second floating bodies on water or sea using a mooring line, the mooring line mechanically installed on a portion of the first floating body and configured to physically moor and hold the first floating body on water or sea independently of the first coupling member, after the first and second floating bodies are magnetically connected to each other. Each of the first and second magnets may include an electromagnet which is magnetized or has an adjustable magnetic pole. The magnet and the coupling member of the floating body may be vertically aligned relative to a plane of the main floating body to facilitate direct vertical coupling with the adjacent floating body. The magnet may be exposed to an exterior of the floating body. The magnet and the coupling member of the floating body may have a same length.

As illustrated in FIGS. 1 and 2, as the floating body which is moored in water or the sea such that aquatic or marine facilities are installed on the floating body, or which provides space for aquatic or marine activities, the floating body of the present disclosure may include a main floating body 100, a magnet 200, a coupling member 300, and a mooring line 400.

The main floating body 100 can float on water or the sea by using buoyancy.

The magnet 200 may be provided on a first vertical side of the main floating body 100. The magnet 200 may be a permanent magnet and may have a specific pole exposed to the outside such that another magnet or iron can be induced to be coupled to the magnet 200.

The magnet 200 may be an electromagnet.

The electromagnet which is the magnet 200 may be magnetized or have a magnetic pole adjusted by the control of a controller 50. Specifically, the electromagnet is a magnet that is magnetized when an electric current flows therein and returns to an initial unmagnetized state when the electric current is cut off therein, and is distinct from a permanent magnet, which constantly retains magnetism regardless of the supply of an electric current. As for the electromagnet, when an electric current flows through a conducting wire, a concentric magnetic field is formed around the conducting wire. Using this principle, the electromagnet can obtain a very strong magnetic field that cannot be obtained with the permanent magnet. When the iron core of the electromagnet is magnetized to a certain extent, magnetization does not proceed any more even if an electric current is increased. This is called Magnetic saturation.

An electromagnet can change the intensity of a magnetic field relatively easily by artificially adjusting an electric current. Therefore, the electromagnet is widely used from a relay of a communication device to an electromagnetic crane that lifts heavy materials of one ton or more.

The coupling member 300 may be provided on an opposite vertical side of the main floating body 100 by corresponding to a magnet 200 of another floating body such that the coupling member 300 is coupled thereto.

The coupling member 300 may be steel with magnetism. Specifically, the coupling member 300 may be made of steel such as iron with magnetism and may be installed on a part of the opposite vertical side of the main floating body 100 with the coupling member 300 being exposed to the outside, and may be coupled to a magnet 200 of another main floating body 100.

The coupling member 300 may be a magnet 200. That is, an N magnetic pole is installed on the first vertical side of the main floating body with the N pole exposed to the outside, and an S magnetic pole is installed on the opposite vertical side of another main floating body with the S pole exposed to the outside, so the coupling of the main floating bodies to each other can be induced. The magnet 200 may be a permanent magnet or electromagnet, and details thereof are the same as described above.

The magnet 200 and the coupling member 300 described above may be provided respectively on the first and opposite vertical sides of the main floating body 100. In addition, the magnet 200 and the coupling member 300 may constitute the entirety of side surfaces of the first and opposite vertical sides of the main floating body 100, and the range of vertical movement of the main floating body 100 may be maintained and held through hinges or through the adjustment of a limit value as a separate concept.

The mooring line 400 may be installed on a part of the main floating body 100 and may moor and hold the main floating body 100 on water or the sea.

The controller 50 is provided with a wireless communication module and operates in cooperation with an external mobile terminal through one of a Wi-Fi communication module, a Bluetooth communication module, and a Zigbee communication module so as to control the operation of the controller from the outside or to check a control situation thereof in real time.

Accordingly, the floating bodies connected to each other without a mooring line according to the embodiment of the present disclosure are connected to each other and arranged as described above, and the horizontal movement of the floating bodies 10 on a plane is maintained and held through the magnetism of the magnet 200 and the coupling member 300, and the range of vertical movement of the floating bodies 10 may be maintained and held through hinges or through the adjustment of a limit value as a separate concept.

Figure 3:
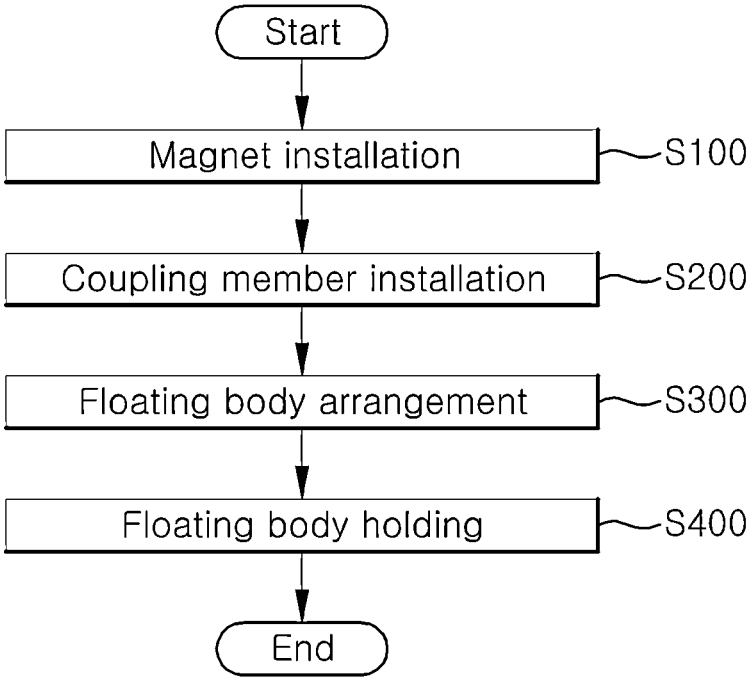
FIG. 3 is a flowchart of a connection method of the floating bodies without a separate connection device according to the embodiment of the present disclosure.

FIG. 3 is a flowchart of a connection method of the floating bodies without a separate connection device according to the embodiment of the present disclosure.

As illustrated in FIG. 3, the floating body connection method of using the floating bodies connected to each other without a mooring line described above may include magnet installation S100, coupling member installation S200, floating body arrangement S300, and floating body holding S400.

The magnet installation S100 is a step of installing a magnet 200 on a first vertical side of a floating body 10.

The coupling member installation S200 is a step of installing the coupling member 300, which is steel, coupled to an opposite vertical side of the floating body 10 by corresponding to a magnet 200 of another floating body.

The floating body arrangement S300 is a step of arranging floating bodies 10 by matching a magnet 200 and a coupling member 300 of each of the floating bodies 10 passing through the magnet installation S100 and the coupling member installation S200.

The floating body holding S400 is a step of holding, by the mooring line 400, the floating bodies 10 floating on water by being connected to each other after the floating body arrangement S300.

The magnet 200 may be an electromagnet whose magnetization is given or magnetic pole is adjusted under the control of the controller 50.

In addition, the coupling member 300 may also be the magnet 200.

Details of the following components are the same as described above in the floating body of the present disclosure.

According to the embodiment of the present disclosure, the floating bodies 10 can be connected to each other without a separate connection device by using the magnet 200 and the coupling member 300 provided on a part of the main floating body 100.

Accordingly, the floating bodies 10 are connected to each other more conveniently than by using separate connection devices such as hinges, joints, wires, or chains, and it is possible to prevent a situation in which the floating bodies 10 are disconnected from each other due to wear of the connection devices due to the influence of the current.

The detailed description of the exemplary embodiments of the present disclosure disclosed as described above is provided to enable those skilled in the art to embody the present disclosure. Although the above has been described with reference to the exemplary embodiments of the present disclosure, it will be understood by those skilled in the art that various modifications and changes can be made to the present disclosure without departing from the scope of the present disclosure. For example, those skilled in the art may use components described in the above-described embodiments in such a manner that the components are combined with each other. Accordingly, the present disclosure is not intended to be limited to the embodiments shown herein but is to be accorded the widest scope consistent with principles and novel features disclosed herein.

The present disclosure may be embodied in other specific forms without departing from the spirit and essential characteristics of the present disclosure. Accordingly, the above detailed description should not be construed as restrictive in all respects but as illustrative. The scope of the present disclosure should be determined by a reasonable interpretation of the appended claims, and all modifications within the equivalent scope of the present disclosure are included in the scope of the present disclosure. The present disclosure is not intended to be limited to the embodiment shown herein but is to be accorded the widest scope consistent with the principles and novel features disclosed herein. In addition, claims that are not explicitly cited in the claims may be combined with each other to form an embodiment, or may be included as new claims by amendment after filing.

What is claimed is:

1. A floating body configured to be moored on water or sea to install or provide space for aquatic or marine facilities, the floating body being connectable to an adjacent floating body without a separate connection device, the floating body comprising:

a main floating body configured to float on water or sea by using buoyancy, the main floating body comprising top and bottom surfaces opposing each other;

a magnet provided on a first vertical side of the main floating body, the magnet extending along the first vertical side from the top surface to the bottom surface of the main floating body;

a coupling member provided on an opposite vertical side of the main floating body, the coupling member extending along the opposite vertical side from the top surface to the bottom surface of the main floating body, the coupling member being configured to engage with a magnet of an adjacent floating body such that the main floating body is connectable to the adjacent floating body along the first vertical side and the opposite vertical side of the main floating body; and a mooring line mechanically installed on a portion of the main floating body and configured to physically moor and hold the main floating body on water or sea independently of the coupling member, wherein the magnet comprises an electromagnet, wherein the electromagnet is configured to be magnetized or has an adjustable magnetic pole, and wherein the coupling member comprises steel with magnetic properties.

2. The floating body of claim 1, wherein the magnet and the coupling member of the floating body are vertically aligned relative to a plane of the main floating body to facilitate direct vertical coupling with the adjacent floating body.

3. The floating body of claim 1, wherein the magnet is exposed to an exterior of the floating body.

4. The floating body of claim 1, wherein the magnet and the coupling member of the floating body have a same length.

5. A floating body connection method for connecting a first floating body and a second floating body configured to be moored on water or sea to install or provide space for aquatic or marine facilities, the first and second floating bodies being connectable to each other without a separate connection device, the method comprising:

installing a first magnet on a first vertical side of the first floating body, the first magnet extending along the first vertical side from a top surface to a bottom surface of the first floating body;

installing a first coupling member coupled to an opposite vertical side of the first floating body, the first coupling member extending along the opposite vertical side from the top surface to the bottom surface of the first floating body, the first coupling member being configured to engage with a second magnet of the second floating body such that the first coupling member is connectable to the second floating body along the first vertical side and the opposite vertical side of the first floating body;

arranging the first and second floating bodies by matching the first magnet and the first coupling member of the first floating body and the second magnet and the second coupling member of the second floating body so that the first magnet and the first coupling member magnetically engage respectively with the second coupling member and the second magnet along the first vertical side and the opposite vertical side of the first floating body; and holding the first and second floating bodies on water or sea using a mooring line, the mooring line mechanically installed on a portion of the first floating body and configured to physically moor and hold the first floating body on water or sea independently of the first coupling member, after the first and second floating bodies are magnetically connected to each other, wherein each of the first and second magnets comprises an electromagnet which is magnetized or has an adjustable magnetic pole.

* * * * *